United States Patent [19]

Grauf

[11] Patent Number: 4,756,408

[45] Date of Patent: Jul. 12, 1988

[54] SLOPED DISPLAY CARTON

[75] Inventor: Karl L. Grauf, Jackson, Miss.

[73] Assignee: Manville Corporation, Denver, Colo.

[21] Appl. No.: 84,280

[22] Filed: Aug. 10, 1987

[51] Int. Cl.[4] ..... B65D 5/06

[52] U.S. Cl. ..... 206/44 R; 206/45.18; 229/108; 229/164; 229/41 R

[58] Field of Search ..... 229/160, 112, 164, 108, 229/41 R, 41 B; 206/44 R, 45.14, 45.18, 425

[56] References Cited

U.S. PATENT DOCUMENTS

| | | | |
|---|---|---|---|
| 1,931,213 | 10/1933 | Wheeler | 229/108 |
| 2,052,675 | 9/1936 | Tanner | 206/45.18 |
| 2,237,706 | 4/1941 | Islieb | 229/112 |
| 2,269,999 | 1/1942 | Daniel | 206/425 |
| 3,004,656 | 10/1961 | Dubey | 206/44 R |
| 4,477,016 | 10/1984 | Growney | 206/44 R |

FOREIGN PATENT DOCUMENTS

| | | | |
|---|---|---|---|
| 353059 | 7/1931 | United Kingdom | 206/44 R |
| 689838 | 4/1953 | United Kingdom | 206/45.14 |
| 1346801 | 2/1974 | United Kingdom | 206/44 R |

*Primary Examiner*—Stephen Marcus
*Assistant Examiner*—Gary E. Elkins
*Attorney, Agent, or Firm*—John D. Lister; Cornelius P. Quinn

[57] ABSTRACT

A display carton for use with articles which cannot independently support themselves in an upright position. The carton is formed so that the back panel forms an angle greater than 90° with the bottom panel to allow such articles to lean back against the back panel. The front panel may also be at the same angle. The bottom is formed from flaps foldably attached to the front, side and bottom panels which function to automatically form the bottom panel when a carton sleeve is opened into carton shape.

10 Claims, 5 Drawing Sheets

FIG. 7A
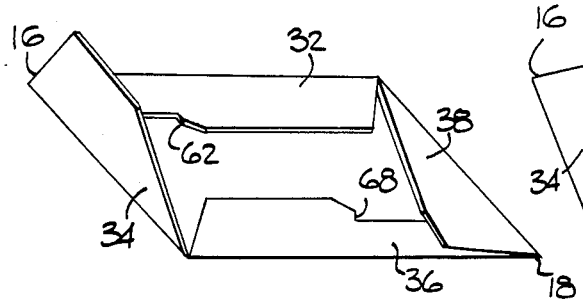
FIG 7B
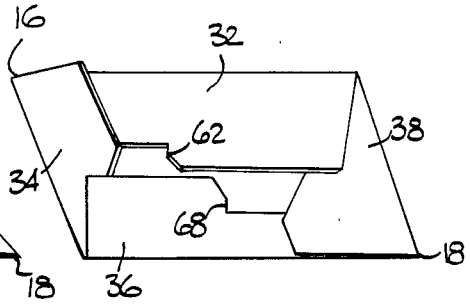
FIG 7C
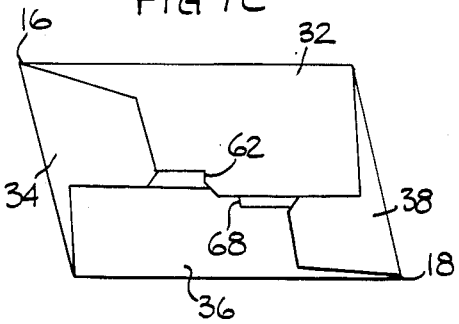
FIG 7D
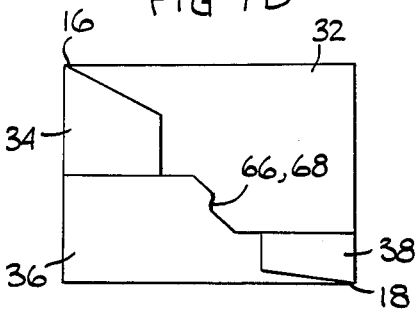
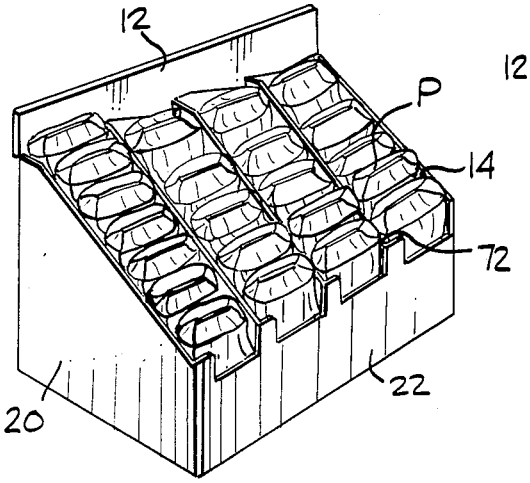
FIG. 8.
FIG. 9.
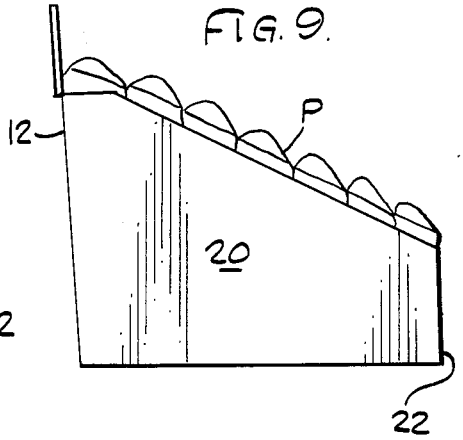

FIG. 11.
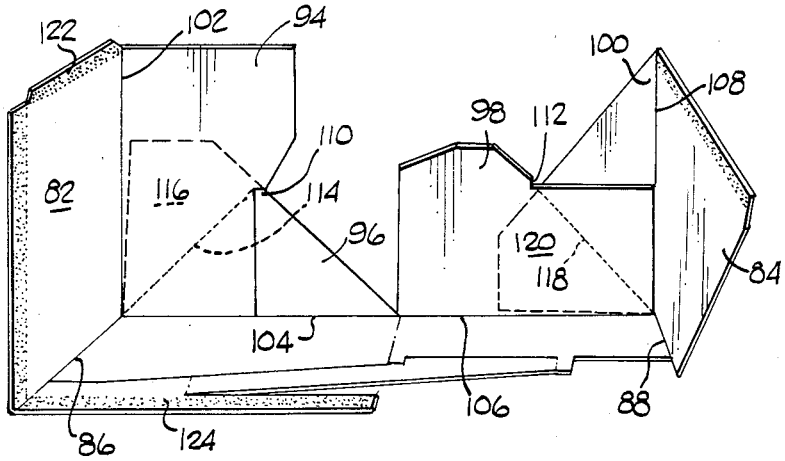
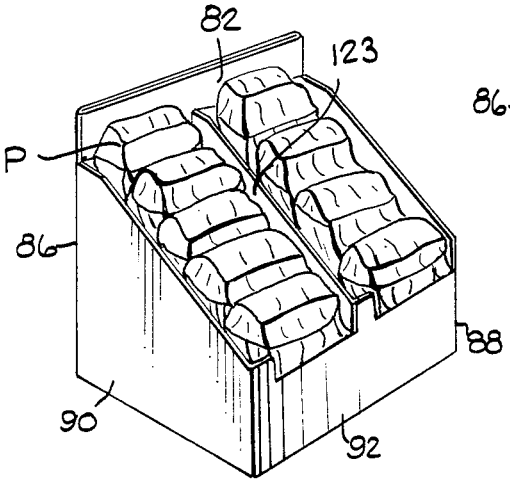
FIG. 12.
FIG. 13.
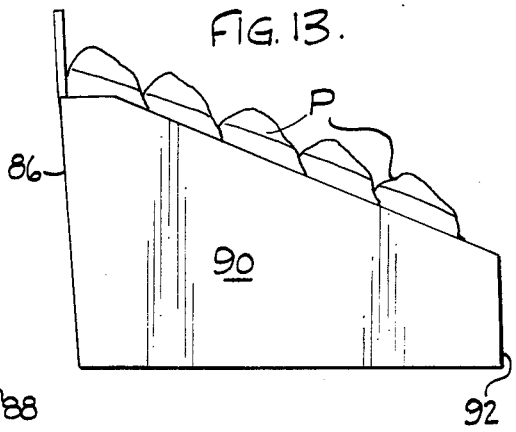

SLOPED DISPLAY CARTON

FIELD OF THE INVENTION

This invention relates to display cartons, and more particularly to display cartons for holding articles which are unable to stand upright independently of external support.

BACKGROUND OF THE INVENTION

Display cartons typically are produced in blank form and are erected by the packager when the articles to be displayed are loaded. Normally the blanks are of a design permitting them to be shipped in a folded partially erected condition which allows a relatively small shipping carton to be used and permits the packager to fully erect the display carton quickly and easily simply by squeezing the folded blanks open. The bottom panels in such cartons are typically automatically formed by the coming together and interlocking of flaps connected to the side panels of the carton. Such display cartons can readily be used with articles which are themselves free standing. The display cartons in such cases need only offer sufficient space for the articles to fit, and do not have to be specially designed in order to support or contribute to the support of the articles.

When the articles are not self-supporting the conventional type of display carton will not suffice. Articles such as bags or packets of rice or other granular material, for example, present a particular problem. They have no ability to stand upright on their own and tend to slump down even when propped up to an extent by adjacent packets. When some of the packets are removed from the display carton the rest tend to fall to the bottom.

It would be advantageous to have a display carton which is not only capable of holding packets of granular material but which can still be shipped to the packager in folded form and be automatically erected by squeezing the folded blank open.

BRIEF SUMMARY OF THE INVENTION

This invention provides a display carton which is especially adapted to receive and display articles which are unable to stand upright independently of external support. The back panel is taller than the front to allow the contents of the carton to be viewed and the bottom panel is comprised of interconnected bottom flaps, each of the front, back and side panels being foldably connected to the bottom panel flaps. In addition, the back panel forms an angle with the bottom panel of greater than 90° so that the back panel slopes back from the bottom panel. The packets of material are thus able to lean back against the back panel so that they are supported in display position by the bottom and back panels. Preferably the front panel is sloped similar to the back panel. In addition, the display area can be broken into cells by providing one or more separating strips extending from the back panel to the front panel.

A display carton of the type described is made possible by the design of the blank in which the fold lines connecting the front and back panel sections to the bottom flaps are substantially perpendicular to the fold lines connecting the front, back and side sections together and lie in planes which are substantially parallel to but spaced from each other. The fold lines connecting the side panel sections to the bottom flaps extend at an angle to the planes in which the first mentioned fold lines lie so that the back panel of the carton forms an angle of greater than 90° with the bottom panel of the carton. The bottom panel flaps, despite the angled arrangement enabling the articles to be supported by the sloped back panel, are formed in such a way that they automatically interlock upon the blank sleeve being squeezed open into the carton shape.

Other features and aspects of the invention, as well as its various benefits, will become clear in the more detailed description of the preferred embodiment which follows.

BRIEF DESCRIPTION OF THE DRAWINGS

FIGS. 7A–7D are plan views of the inside face of the bottom panel of a display carton, showing sequentially the closing and locking of the bottom panel flaps as the flattened sleeve of FIGS. 5 and 6 is opened;

FIG. 8 is a pictorial view of the fully erected display carton formed from the blank of FIG. 1;

FIG. 9 is a side elevation of the carton of FIG. 8;

FIG. 11 is a pictorial view similar to that of FIG. 2, but showing the folding of the blank of FIG. 10;

FIG. 12 is a pictorial view of the fully erected display carton formed from the blank of FIG. 10; and FIG. 13 is a side elevation of the carton of FIG. 12.

DESCRIPTION OF THE INVENTION

Figure 1:
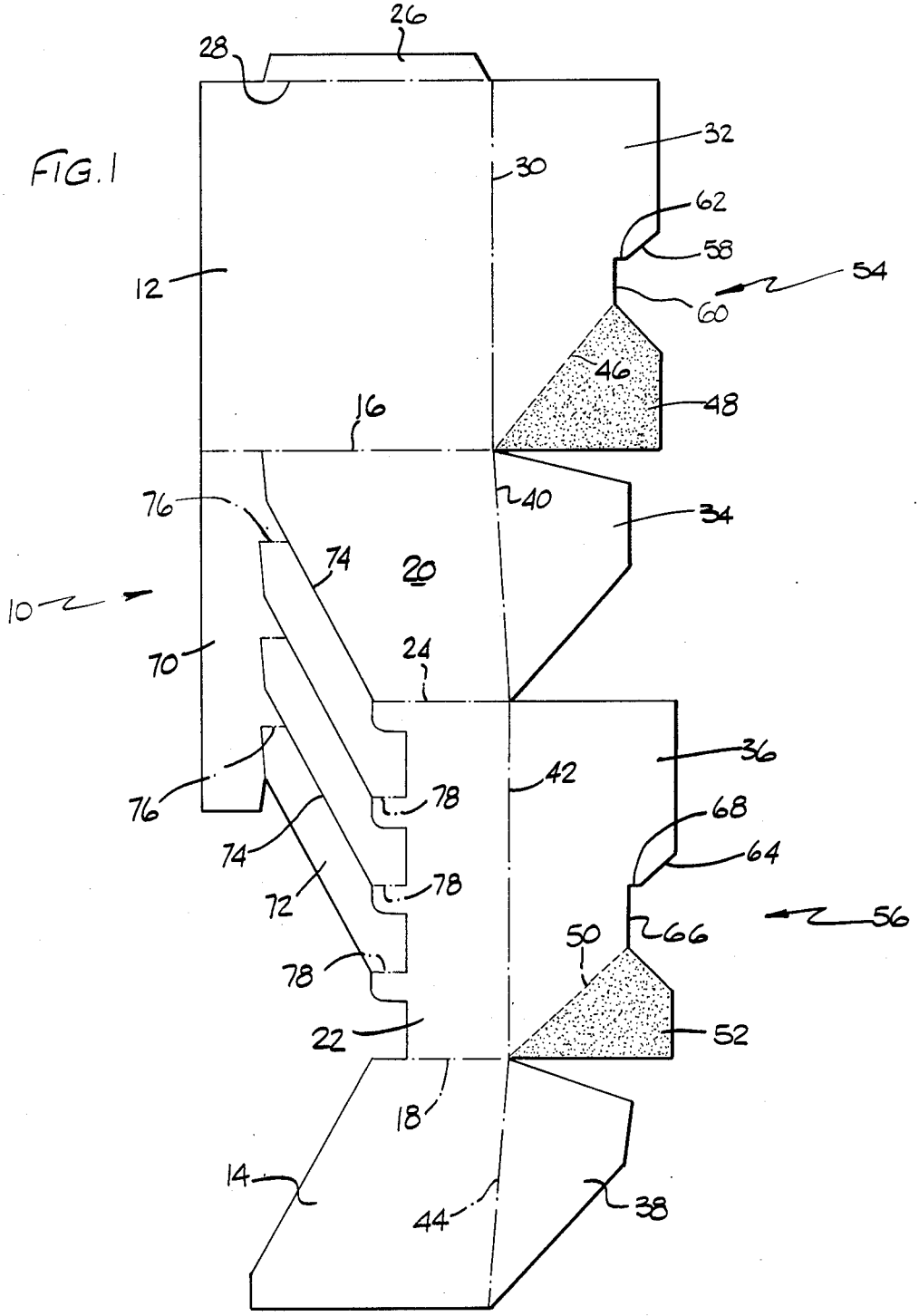
FIG. 1 is a plan view of a blank used to fabricate one embodiment of the sloped display carton of the invention.

Referring to FIG. 1, one embodiment of the blank of the present invention is indicated generally at 10 and includes end sections 12 and 14 connected by score lines 16 and 18 to intermediate sections 20 and 22. The intermediate sections are connected to each other by score line 24. The end section 12 corresponds to the back panel of the display carton formed from the blank and the end section 14 corresponds to the right side panel. The intermediate section 20 corresponds to the left side panel of the display carton and the other intermediate section 22 corresponds to the front panel of the carton. The score lines 16, 18 and 24 are substantially parallel to each other so as to form a carton having a rectangular bottom. A glue tab 26 extending outwardly from the free edge of the end section 12 along score line 28 is adapted to be glued to the edge protion of the other end section 14 after the sections have been folded about their score lines 16, 18 and 24 in order to hold the carton in place. The length of the tab 26 is about the same as the length of the the free edge of the end section 14 so that the tab can be adhered to the side panel of the carton formed from the blank along substantially the full height of the side panel.

Connected to the section 12 along score line 30 is a bottom flap 32. Similarly, bottom flaps 34, 36 and 38 are connected to sections 20, 22 and 14 along score lines 40, 42 and 44, respectively. The score lines 30 and 42 are substantially perpendicular to the score lines 16, 24 and 18 and thus are parallel to each other. The score lines 40, connecting the score lines 30 and 42, forms an angle greater than 90° with the score line 24. The amount by which these angles differ from 90° is the angle at which the front and back panels of the display carton will slope with respect to the bottom panel. A similar arrangement is found with the score line 44, which makes an angle with score line 18 similar to the angle formed by score lines 24 and 40 and which is designed to form an anagle with the score line 28 of the end section 12 similar to the angle formed by the score line 40 with the score line 16. With this arrangement the score lines 30 and 42 thus lie in parallel but spaced apart planes.

Extending from the intersection of score lines 30, 16 and 40 toward the far edge of the bottom flap 32 is a fold line 46, which forms a wedge-shaped portion 48 in the end of the flap 32 adjacent the bottom flap 34. A similar arrangment is formed in the bottom flap 36 by fold line 50, which forms wedge-shaped portion 52 in the end of the flap 36 adjacent the bottom flap 38. These wedge-shaped portions are adapted to be glued to their adjacent bottom flaps 34 and 38 and to act as tuck flaps in the formation of the bottom panel of the carton. In addition, the bottom flaps 32 and 36 contain cutouts 54 and 56, cutout 54 including edges 58 and 60 which are connected by a short shoulder portion 62, and cutout 56 including edges 64 and 66 which are connected by a short shoulder portion 68. The shoulder portions 62 and 68 are adapted to lock into place with each other to form a bottom panel in a manner explained in more detail hereinafter.

The blank 10 also contains a header portion 70 which is connected to the end section 12 along score line 16 and which extends away from the section 12 a distance equal to the length of the score line 30. The header portion is adapted to be folded back against the section 12 and to be adhered thereto so as to extend across the full width of the back panel of a carton formed from the blank, as explained in more detail below. Extending from the header portion 70 to the front panel section 22 are straps or partitions 72 formed by slits 74. The straps 72 are connected at one end to the header portion by fold lines 76 and at their other end they are connected to the section 22 by fold lines 78.

Figure 2:
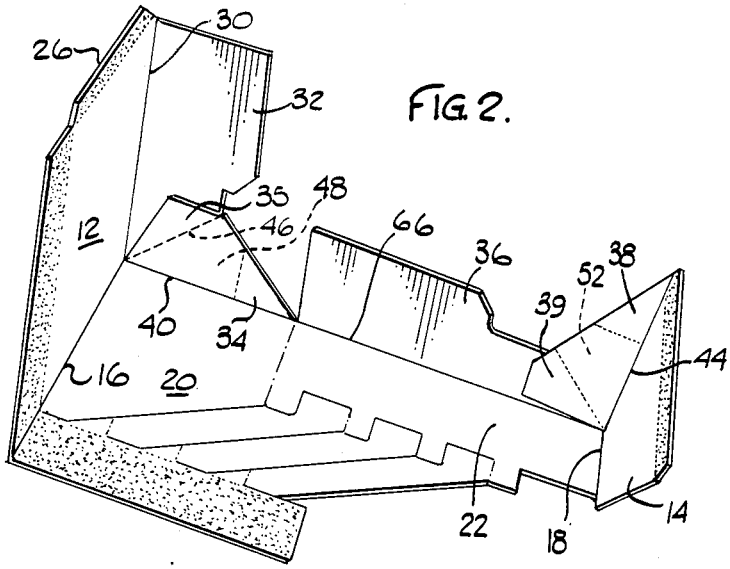
FIG. 2 is a pictorial view of the blank of FIG. 1, showing the blank in an interim condition as it is being folded to form a flattened sleeve.

Referring to FIG. 2, and also at times to FIG. 1 as well, the blank is shown partially folded in an interim condition while resting on the intermediate sections 20 and 22, with the viewer seeing the inside of what will eventually be the display carton. The back section 12 has been folded to an upright position about score line 16 and the right side section 14 has been folded to an upright position about score line 18. In addition, bottom flaps 32, 34, 36 and 28 have been folded at right angles to their connected sections 12, 20, 22 and 14, respectively. In the process of making these folds the tuck flap 48 will be covered by the flap 34 and the tuck flap 52 will be covered by the flap 38. In this position the tuck flaps 48 and 52 are gluded to the flaps 34 and 38, respectively. The tuck flaps or glue flaps 48 and 52 are shown in stipple in FIG. 1.

Figure 3:
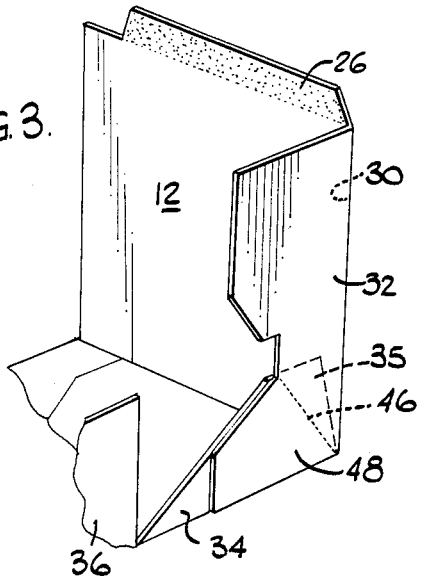
FIG. 3 is a partial pictorial view of the blank of FIG. 2, showing the upright back panel section and the adjacent upright bottom panel sections.
Figure 4:
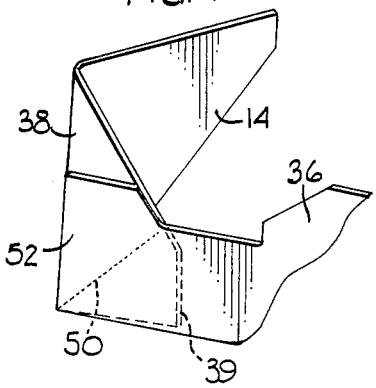
FIG. 4 is a partial pictorial view of the blank of FIG. 2, showing the upright right side panel section and the adjacent upright bottom panel sections.

The semi-erected carton is now ready to be folded to put it into condition for shipping. This is done by folding down the back panel section 12 about the score line 16 and folding down the back side section 14 about the score line 18. This causes the bottom flaps 32 and 38 to fold inwardly about score lines 30 and 44. It also causes the bottom flaps 34 and 36 to fold downwardly along score lines 40 and 66, this being possible due to the ability of the flap 32 to fold along fold line 46 and the ability of flap 36 to fold along fold line 50. The relative positions of the various flaps and sections are shown from a different perspective in FIGS. 3 and 4. As can be seen in FIG. 3, the flap 34 and adhered tuck flap 48 would be folded down as the flap 32 is folded inwardly. The end portion of the flap 34 which is not adhered to the tuck flap 48 is shown at 35 to extend inwardly into the interior of the carton. In like manner, in FIG. 4 the flap 36 and integral tuck flap 52 would be folded down as the flap 38 is folded inwardly. The end portion of the flap 38 which is not adhered to the tuck flap 52 is shown at 39 to extend into the interior of the folding carton.

Continued downward folding of the sections 12 and 14 results in these sections being substantially parallel to the left side section 20 and the front section 22, with the bottom panel flaps being sandwiched therebetween. At this point the glued strip 26 is adhered by suitable adhesive to the free edge portion of the right side panel section 14 and the header portion 70 is adhered to the opposing surface of the back panel section 12. These glued areas are shown in stipple in FIG. 2.

Figure 5:
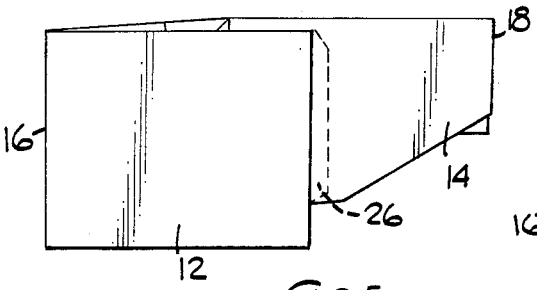
FIG. 5 is a plan view of the back of a flattened sleeve resulting from the continued folding of the blank of FIG. 2.
Figure 6:
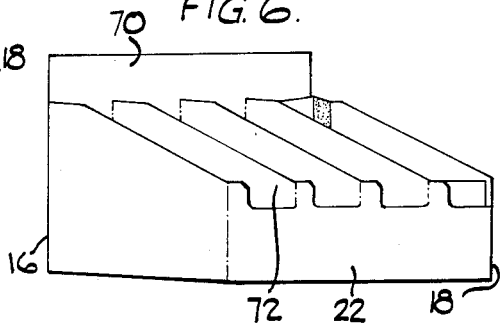
FIG. 6 is a plan view of the front of the flattened sleeve of FIG. 5.

One side of the resulting flattened carton sleeve is shown in FIG. 5 wherein the tab 26 is attached to the right side panel 14. The reverse side of the flattened sleeve is shown in FIG. 6, which shows the partition strips 72 lying flat in the same plane as the header portion 70 and the front panel 22. It will be understood that when the opposite corners of the sleeve, or in other sords the opposite fold lines 16 and 18, are pushed toward each other the carton side panels and the front and back panels arrange themselves so that the internal angles at the juncture of these panels are substantially right angles. At the same time the bottom flaps are moved together to form a continuous bottom panel. The stages by which this happens are illustrated in FIGS. 7A–7D, which are progressive views of the bottom of the carton sleeve, looking down into the sleeve as it is being opened.

As shown in FIG. 7A, the initial movement of the corners 16 and 18 of the bottom panel toward each other causes the bottom panel flaps 32, 34, 36 and 38 to assume the approximate positions illustrated, wherein the flaps have started folding out from their relatively flat overlying position with respect to the side, front and back panels. Continued squeezing of the fold lines 16 and 18 of the sleeve toward each other results in the bottom flaps folding farther away from the panels to which they are foldably connected and brings the locking portions 62 and 68 closer together, as shown in FIG. 7B. In FIG. 7C the bottom flaps have been folded down to a point where the flap 36 is beginning to overlie flap 34, and flap 32 is beginning to overlie flap 38. The edge of flap 36 is sliding underneath the flap 32 and the locking shoulders 62 and 68 are moving toward each other. Finally, in FIG. 7D the bottom of the carton is shown in its fully closed and locked condition, with the flaps overlapping each other such that a continuous bottom panel is provided and such that the locking shoulders 62 and 68 are in locking engagement to hold the interconnected flaps in fixed relationship.

The erected carton is shown in FIG. 8 as having four cells formed by the straps 72 extending between the front panel 22 and the back panel 12. The back panel is higher than the front to allow the packets P to be displayed more prominently. As shown in FIG. 9, which is a side view of the carton of FIG. 8, the back and front panels are angled back so that they slope with respect to the bottom panel. The packets in contact with the back panel to an extent allowing the packets to be as upright as possible without slumping down. The packets in front of the back row of packets would obviously lean back against each other at substantially the same angle, thereby providing a functional pleasing display which results in all the packets being suitably supported and shown off to best advantage.

Referring back to FIG. 1, the angles formed by the score lines 40 and 44 with score lines 30 and 42 determine the angle at which the front and back panels slope with respect to the bottom panel. The angle chosen will relate to the characteristics of the article being displayed. An article such as a very limp packet of granular material will need more of an angle than a more rigid article. While the angle may thus vary according to conditions, it has been found that it will best fall into the range of about 1°–10°. The smaller angle is the minimum angle at which a beneficial effect may be noticed, while angles greater than the maximum run the risk of the filled carton toppling backward when loaded. As an example, if a slope angle of 4° is desired the angle between score lines 40 and 42 would be 176° and the angle between score lines 42 and 44 would be the same. The 4° angle would also impact the angle at which the fold lines 46 and 50 extend into the bottom flaps 32 and 36 to form the tuck flaps 48 and 52, as well as the angle at which the flaps 34 and 38 extend from the fold lines 40 and 44, respectively. Another factor affecting the fold line angles, however, is the length of the carton as compared to its width, which controls the comparative lengths of the bottom flaps 32 and 36 to their adjacent flaps 34 and 38. Thus in the example shown in FIG. 1 the fold line 46 makes an angle of 43° with the score line 30 and the fold line 50 makes an angle of 47° with the score line 42, the difference between the angles being 4°. This is in contrast to these angles being equal angles of 45° if the back panel were vertical instead of sloped. In either case, however, the sum of the angles is 90°. In the same 4° slope situation, the edge of the flap 34 which is closest to the flap 36 forms an angle of 47° with the score line 40, and the edge of the flap 38 adjacent the free edge of end section 14 forms an angle of 43° with the score line 44. All the angles referred to would of course be altered accordingly if the slope angle changed.

Figure 10:
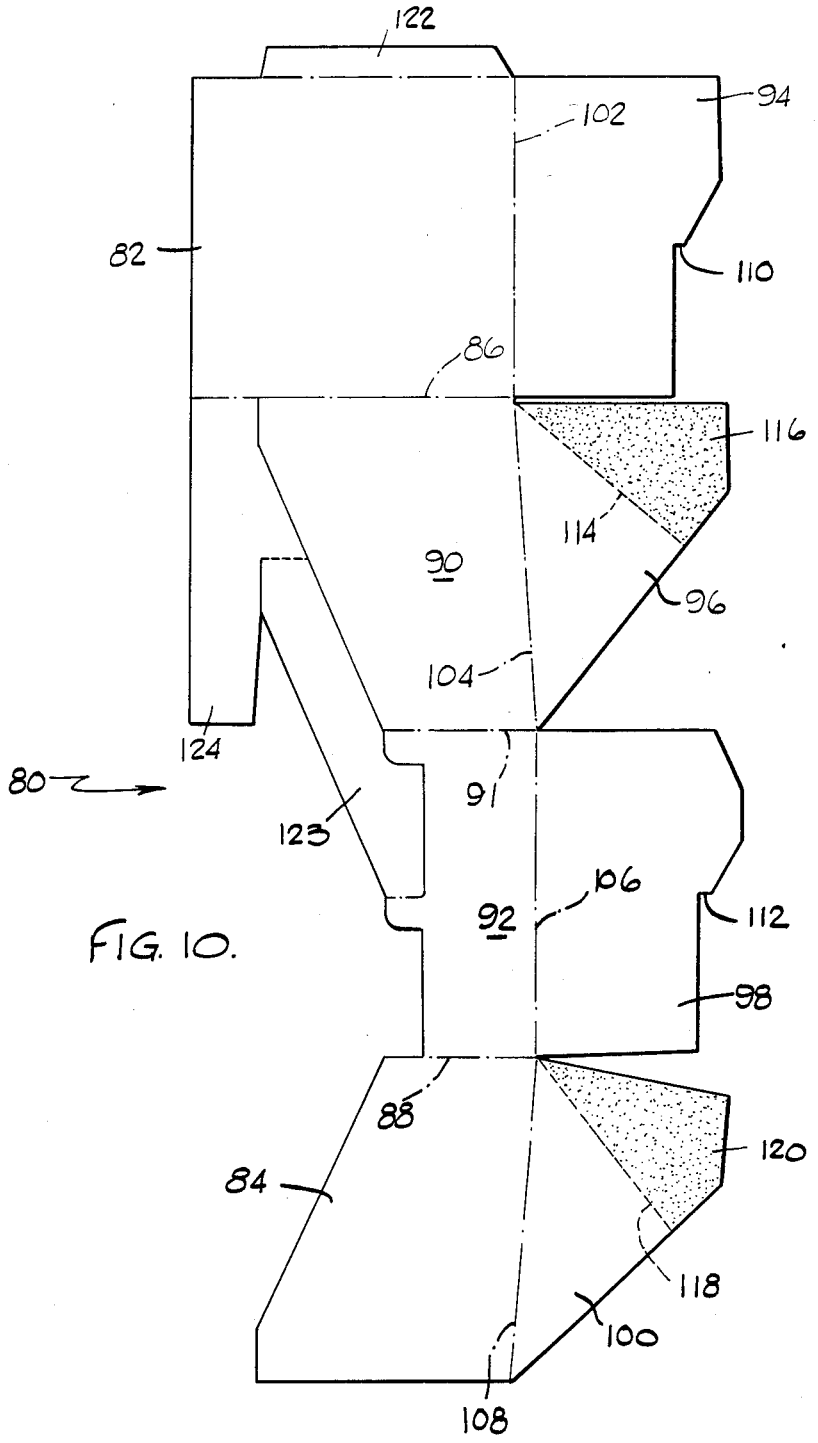
FIG. 10 is a plan view similar to that of FIG. 1, but showing a different embodiment of the invention.

In another example a shorter carton requiring only a single partition strap can be formed from the blank shown in FIG. 10. As in the blank of FIG. 1, the blank 80 is formed of end sections 82 and 84 connected by score lines 86 and 88 to intermediate sections 90 and 92, the latter sections being connected by score line 91. Bottom flaps 94, 96, 98 and 100 are connected to sections 82, 90, 92 and 84, resectively, by score lines 102, 104, 106 and 108. The locking portions of the bottom panel are located as in the first embodiment in the flaps connected to the back panel section and to the front panel section. Thus the locking shoulder 110 is in the flap 94 and the locking shoulder 112 is in the flap 98. In this embodiment, however, the tuck flaps are in different bottom flaps. Thus fold line 114, forming tuck flap 116, is located in flap 96 which is connected to side panel section 90. Similarly, fold line 118, which forms tuck flap 120, is located in flap 100 which is connected to side panel section 84. This arrangement is employed when, as in this case, the carton is relatively short with respect to its width. If the carton were relatively long compared to its width the arrangement would be as in the first embodiment, with the tuck flaps in the bottom flaps connected to the back and front panel sections. In the blank of FIG. 10 a single partition strip 123 is shown connecting the front panel section 92 and the header portion 124. Since the carton is relatively short the display space in this case need be broken down into only two cells. The tuck flaps 116 and 120 are shown in stipple, indicating the areas to be glued to the adjacent bottom flaps in the formation of a carton.

Referring now to FIG. 11, the blank 80 of FIG. 10 is shown in a view similar to that of FIG. 2, with the back panel section 82 and the right side panel section 84 folded up about their scroe lines 86 and 88, respectively. In addition, bottom flap 94 has been folded inwardly about score line 102 and bottom flap 100 has been folded inwardly about score line 108. Flaps 96 and 98 have also been folded up about the score lines 104 and 106. The tuck flap 116 has been glued to the flap 94 and the tuck flap 120 has been glued to the flap 98. When the flaps 82 and 84 are folded down to form a flattened sleeve the adhered flaps 94 and 96 are folded in about their score lines 102 and 104, made possible by the folding of flap 96 along fold line 114. In the same way the adhered flaps 98 and 100 are folded in about their score lines 106 and 108, with folding also taking place along fold line 118. As in the first embodiment, the flattened sleeve is held in place by the gluing of the free edge portion of the right side panel section 84 to the glue strip 122 and by the gluing of the header portion 124 to the adjacent portion of the back panel section 82. These areas of gluing are shown in FIG. 11 by stippling.

The sleeve is opened in the same manner as the sleeve of the first embodiment, by pushing the remote corners of the sleeve toward each other to cause the panels to move together to form a carton with rectangular corners. The bottom panels during such movement automatically come together in a manner similar to that of the first embodiment so that the locking shoulders 110 and 112 are engaged to hold the bottom panel in place, with the interlocked bottom panels forming a continuous surface.

As shown in FIGS. 12 and 13, the display carton resulting from the blank of FIG. 10 is similar to the carton of FIGS. 8 and 9, having a high back panel, a low front panel, and sloped back and front panels. As in the first embodiment, the articles or packets P are adapted to lean back against the back panel and against each other to be maintained in an upright position to allow them to be on display.

Also as in the first embodiment the angles formed by score lines 104 and 106 and by score lines 106 and 108 determine the slope of the back and front panels of the carton. The angles of the tuck flaps 116 and 120 are determined by not only the slope angle but also by the relative lengths of the bottom flaps. Thus in the embodiment of FIG. 10, with a slope angle of 4°, the angle formed by the fold line 114 and the upper edge of the flap 96 is 39°, while the angle formed by the fold line 118 and the upper edge of flap 100 is also 39°. The angle formed by fold line 114 and score line 104 is 47° and the angle formed by score line 104 and the lower edge of flap 96 is 43°. The angle formed by the fold line 118 and the score line 108 is 43° and the angle formed by the score line 108 and the lower edge of flap 100 is 47°. Thus the sum of the angles formed by the flaps 96 and 100 with their score lines 104 and 108 is equal to 90°.

It should now be apparent that the invention solves the problem of displaying articles that cannot support themselves in an upright position without external help by a simple yet highly effective novel means. By angling the connection between the side panel sections and their bottom flaps a slope can be created between the bottom panel and the front and back panels. By angling these connections in the manner taught in the disclosure the back panel slopes back from the bottom of the carton, enabling a nonstructural article to be supported by both the bottom of the carton and the back panel. This has been achieved not by painstaking hand fabrication at the point of packaging, but has been incorporated in the design of a blank adapted to be folded flat into shipping configuration and then opened at the point of packaging merely by pushing the remote ends of the flat sleeve toward each other. Thus the goals of the invention have been achieved while retaining the desirable features of the automatic bottom.

It should now be obvious that although preferred embodiments of the invention have been described, changes to certain specific details of the embodiments can be made without departing from the spirit and scope of the invention as defined in the claims.

What is claimed is:

1. A production blank for forming an article display carton especially adapted to receive and display articles which are unable to stand upright independently of external support, the blank comprising:

two end sections connected by fold lines to two intermediate sections, the two intermediate sections being connected by fold lines to each other;

each of the sections being connected by fold lines to flaps for forming the bottom panel of a carton formed from the blank;

one of the end sections and the most distant intermediate section therefrom corresponding to the side panels of a carton formed from the blank, the other end section and the other internal section corresponding to the back and front panels of such a carton;

the fold lines connecting the front and back panel sections to the bottom flaps thereof being substantially perpendicular to the fold lines connecting the sections to each other and lying in planes which are substantially parallel to but spaced from each other;

the fold lines connecting the side panel sections to the bottom flaps thereof extending at an angle to said planes, the ends of such fold lines being adjacent the ends of the fold lines connecting the front and back panel sections to the bottom flaps thereof; and means for adhering the free edges of the end sections to each other to hold the blank in carton form, whereby the back panel of the carton forms an angle with the bottom panel of the carton greater than 90° to permit articles unable to stand upright independently of external support to lean back against the back panel.

2. A production blank according to claim 1 wherein the dimension of the front panel section corresponding to the height of the front panel of a carton formed from the blank is less than the dimension of the back panel section corresponding to the height of the back panel of such a carton.

3. A production blank according to claim 2, including additionally a header section connected by a fold line to the back panel section and adapted to be folded back against the upper portion of the back panel of a carton formed from the blank, and at least one strip foldably connecting the header section to the front panel section, whereby the strip separates the interior of such a carton into cells for receiving articles to be displayed.

4. A production blank according to claim 2, wherein one of the end sections is the back panel section.

5. A production blank according to claim 4, wherein the fold line connecting the back panel section to the bottom flap thereof forms an angle slightly greater then 180° with the fold line connecting the adjacent side panel section to the bottom flap thereof.

6. A production blank according to claim 5, wherein the fold line connecting the front panel section to the bottom flap thereof forms an acute angle slightly less than 180° with the fold lines connecting the adjacent side panel sections to the bottom flaps thereof, whereby the front panel of a carton formed from the blank forms an angle with the bottom panel of such a carton so that the front and back panels are substantially parallel.

7. A production blank according to claim 1, wherein the end sections of the blank are adapted to be folded inwardly along the fold lines connecting the end sections to the adjacent intermediate sections, and the bottom flaps ae adapted to be folded inwardly along the fold lines connecting the bottom flaps to the end and intermediate sections, whereby the blank can be folded into a flat interim state for shipping.

8. A production blank according to claim 7, wherein a blank in its folded interim state can be opened into carton form, the bottom flaps automatically interlocking when the carton is so opened to form the bottom panel of the carton.

9. A production blank according to claim 8, wherein the bottom flap of the end side panel section contains a fold line extending from the intersection of the bottom flap and the fold line connecting the end side panel section to the adjacent interior section, and the bottom flap of the other side panel section contains a fold line extending from the interaction of said bottom flap and the fold line connecting said other side panel section to its adjacent end section, the bottom flap fold lines forming wedge-shaped bottom flap portions which act as tuck flaps during the folding of the blank into a carton.

10. A production blank according to claim 8, wherein the bottom flap of the end front or back panel section contains a fold line extending from the intersection of the bottom flap and the fold line connecting said end panel section to the adjacent interior section, and the bottom flap of the other front or back panel section contains a fold line extending from the intersection of said bottom flap and the fold line connecting said other front or back panel section to its adjacent end section, the bottom flap fold lines forming wedge-shaped bottom flap portions which act as tuck flaps during the folding of the blank into a carton.

* * * * *

UNITED STATES PATENT AND TRADEMARK OFFICE

CERTIFICATE OF CORRECTION

PATENT NO. : 4,756,408

DATED : July 12, 1988

INVENTOR(S) : Karl L. Grauf

It is certified that error appears in the above—identified patent and that said Letters Patent is hereby corrected as shown below:

Column 8, Claim 6, line 24, after less insert "acute".

Column 8, Claim 7, line 34, delete -ae- and insert therefor "are".

Signed and Sealed this

Seventeenth Day of January, 1989

*Attest:*

DONALD J. QUIGG

*Attesting Officer*

*Commissioner of Patents and Trademarks*